US006790280B2

(12) United States Patent
Lummila

(10) Patent No.: US 6,790,280 B2
(45) Date of Patent: Sep. 14, 2004

(54) CRADLE

(75) Inventor: Markku Lummila, Jyväskylä (FI)

(73) Assignee: Metso Paper Inc., Helsinki (FI)

( * ) Notice: Subject to any disclaimer, the term of this patent is extended or adjusted under 35 U.S.C. 154(b) by 0 days.

(21) Appl. No.: 10/308,382

(22) Filed: Dec. 3, 2002

(65) Prior Publication Data

US 2003/0131790 A1 Jul. 17, 2003

(30) Foreign Application Priority Data

Dec. 4, 2001 (FI) ..... 20010462 U

(51) Int. Cl.[7] ..... B05C 11/02

(52) U.S. Cl. ..... 118/118; 118/119; 118/126; 118/414; 118/262; 162/281; 101/157; 101/169; 101/365; 101/120

(58) Field of Search ..... 118/118, 119, 118/123, 126, 413, 414, 261, 262; 427/356; 162/281; 101/157, 169, 365, 120; 15/256.5

(56) References Cited

U.S. PATENT DOCUMENTS 4,245,582 A 1/1981 Alheid et al.
5,077,095 A 12/1991 Alheid
5,122,396 A 6/1992 Rantanen
5,133,996 A 7/1992 Busker
5,246,497 A 9/1993 Rantanen
5,264,247 A 11/1993 Lintula
5,383,968 A 1/1995 Rantanen et al.
5,462,594 A 10/1995 Rantanen
5,484,482 A 1/1996 Rantanen et al.
5,567,479 A 10/1996 Rantanen
5,595,601 A 1/1997 Lintula
5,605,573 A 2/1997 Salo et al.
5,665,163 A 9/1997 Li et al.
5,824,369 A 10/1998 Li et al.
5,882,406 A 3/1999 Becker et al.
5,980,634 A 11/1999 Tomatis
6,024,797 A 2/2000 Li et al.
6,261,368 B1 7/2001 Wight
6,328,853 B1 * 12/2001 Goodnow et al. ..... 162/281
6,554,900 B1 * 4/2003 Aydin et al. ..... 118/211

FOREIGN PATENT DOCUMENTS

WO WO 00/20123 * 4/2000

* cited by examiner

*Primary Examiner*—Laura Edwards
(74) *Attorney, Agent, or Firm*—Stiennon & Stiennon

(57) ABSTRACT

A cradle for a spreading device, such as a rotatable rod, to which a spreading organ to be pressed against a movable surface has been attached. The cradle is fastened to a holder, and a gasket is provided between the cradle and the holder (9).

21 Claims, 6 Drawing Sheets

CRADLE

CROSS REFERENCES TO RELATED APPLICATIONS

This application claims priority on Finnish Application No. 20010462, Filed Dec. 4, 2001, the disclosure of which is incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to a rod cradle, with the help of which coating mixture is applied onto web material. The invention can be used, for example, in the coating of paper using the film transfer technique.

Paper can be coated using the film transfer technique, in which a coating mixture, such as a coating paste, is spread as a film onto a rotating roll and then transferred in a roll nip to the paper web to be coated. The mixture can be spread to the roll with the help of a rotatable circular film rod, which is located against the roll and parallel to the axle of the rod. From the roll nip between the film rod and the roll, the mixture is transferred as a film to the surface of the roll. The apparatus also comprises a blocking rod to be pressed against the roll, preventing the mixture from flowing downwards. The rods have been placed into rod cradles that have been connected so that a pressurized feed chamber is formed between them. The rod cradle tightly surrounds the rod from the back. The ends of the chamber are provided with edge gaskets that prevent the mixture from flowing away from the edges.

The rod cradle is generally made of suitably flexible material, such as polyurethane plastic. In this way the rod can be pressed evenly and flexibly against the surface of the roll with the help of the cradle. The cradle usually comprises a narrower base section provided with a projection. The cradle is attached to the cradle holder from the base section. An eccentric locking is generally used in fastening the cradle.

It is important in the fastening of the rod cradle that, on the one hand, the cradle can be reliably kept in the holder and, on the other hand, the fastening should be so loose that the cradle can move in the lateral direction. The mobility in the lateral direction is important due to the thermal expansion caused by the possible temperature differences between the beam and the cradle. However, if the fastening is too loose, coating mixture can leak around the base of the cradle. The leak is harmful especially in a coating apparatus without return circulation, because the roll can contain uncoated areas at the places of the leakage. For repairing the leakage, feed has to be increased so that pressure increases in the chamber and it may be necessary to increase the pressure of the blocking rod and the film rod. The leakage also causes loss and environmental contamination. In addition, the leaked coating mixture can dry to the holder and make the detachment of the cradle and the operation of the fastening mechanism more difficult. Too tight a locking of the cradle again causes profile problems in the film, as the thermal expansion of the cradle has been prevented.

The space available for the base section of the cradle is dependent on the tolerances of several parts and also on the measuring accuracy of the cradle and on the contamination of the holder. Thus, it is even possible for the optimal tightness of the fastening to easily change during the run.

SUMMARY OF THE INVENTION

In accordance with the invention, a gasket is located between the cradle and its holder, preventing the coating mixture from getting out of the chamber along this route. Because of the gasket, the fastening between the cradle and the holder can be sufficiently loose so that mobility caused by thermal expansion is possible.

The gasket can be fastened either to the cradle or to the holder, preferably to the cradle. As the gasket is located in the cradle, it is always easily changed together with the cradle.

The gasket can be fastened especially with the help of a fastening groove. The groove fastening is reliable so that the gasket does not easily become detached, for example, upon washing. However, the gasket can also be fastened, for example, by gluing.

The gasket can be for example a tube or tape gasket, especially a tube gasket. When required, pressure medium, such as air, can be directed to the tube for adjusting the sealing power. The gasket can also be a lip gasket of, for example, I, T, Y, V, U, D or P shape. The sealing material can especially be a suitable elastomer, such as silicone, nitrile or ethylene propylene diene rubber, or spring steel.

The rod attached to the cradle can be rotatable.

The cradle can be used both as a film rod cradle and a blocking rod cradle. A spreading device can have both a film rod cradle and a blocking rod cradle. Instead of a blocking rod, the device can have a blocking blade with or without a hole.

The invention can be applied especially in spreading apparatuses without return circulation, but it is also useful in traditional apparatuses provided with return circulation.

Some embodiments of the invention are next explained in more detail.

DESCRIPTION OF THE PREFERRED EMBODIMENTS

Figure 1:
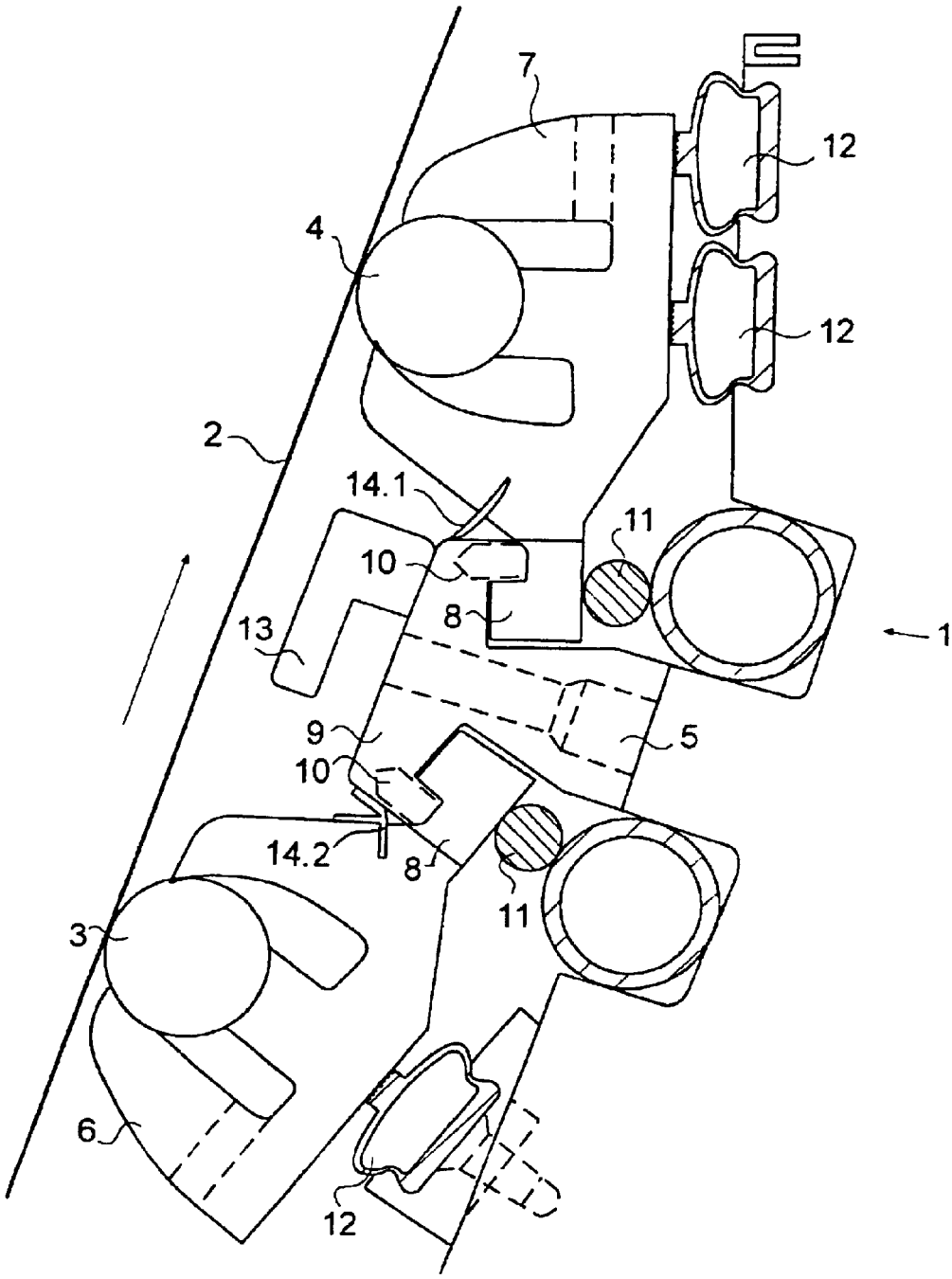
FIG. 1 is a side view of a spreading device with two rod cradles attached to a holder.

In FIG. 1 there is shown a film forming apparatus comprising a spreading device 1 for a coating paste, which device is pressed against a rotatable roll 2 from the side rising upwards.

The spreading device 1 has a rotatable blocking rod 3 to be pressed against the surface of the roll 2 and, above it, a rotatable film rod 4. Coating material is led with pressure to the chamber between the rods from a fitting 5. The rods are rotated to the same direction as the roll or to the opposite direction. Substantially no or only a very little amount of coating material can controllably flow from the nip between the blocking rod and the roll. The coating material to be fed between the rods is transferred from the nip between the film rod 4 and the roll 2 as a film to the surface of the roll. From the roll surface, the film is transferred to the paper web in a transfer nip on the other side of the roll. The space between the rods is closed from the ends against the roll surface using edge gaskets.

The blocking rod 3 is fitted into a blocking rod cradle 6 and the film rod 4 into a film rod cradle 7. The front wall of the cradle is provided with a groove, into which the rod is fitted. Behind the rod there are lubrication grooves, through which water is supplied as a lubricant and a scavenging agent. The lower section of the cradle is narrower, and its lower end has a base 8 pointing forwards, with the help of which the cradle is attached to a cradle holder 9. The cradle holder has a groove corresponding to the base. The cradle is positioned to the cradle holder from its edges with the help of positioning pins 10 and respective grooves. The cradle is made of flexible material appropriate for the purpose of use, such as suitable polyurethane plastic.

The cradle is pressed against the holder 9 behind the base 8 with the help of a locking bar 11 attached to a pivoting axle. The pressing force should be so small that the thermal expansion of the cradle is possible in the lateral direction. From the upper section, the cradle is pressed against the roll 2 with pneumatically driven hoses 12. The blocking rod cradle is here pressed by one hose, the film rod cradle by two.

In front of the holder 9 there is a barrier lath 13, which guides the coating paste flow from the aggregate 5 to the whole width of the chamber.

Above the base section of the cradle 6, 7 between the cradle and the holder there is provided a gasket, which is fastened to a groove made to the cradle. In FIG. 1, the cradles have different kinds of gaskets for illustrating the invention. The film rod cradle 7 has a lip gasket 14.1, and the blocking rod cradle 6 has a T shaped gasket 14.2. The corresponding gasket to be attached to the groove can also be, for example, V shaped.

FIGS. 2–5 present examples of other types of gaskets. Also in these figures, the different cradles have different kinds of gaskets only for illustrating the different embodiments of the invention.

Figure 2:
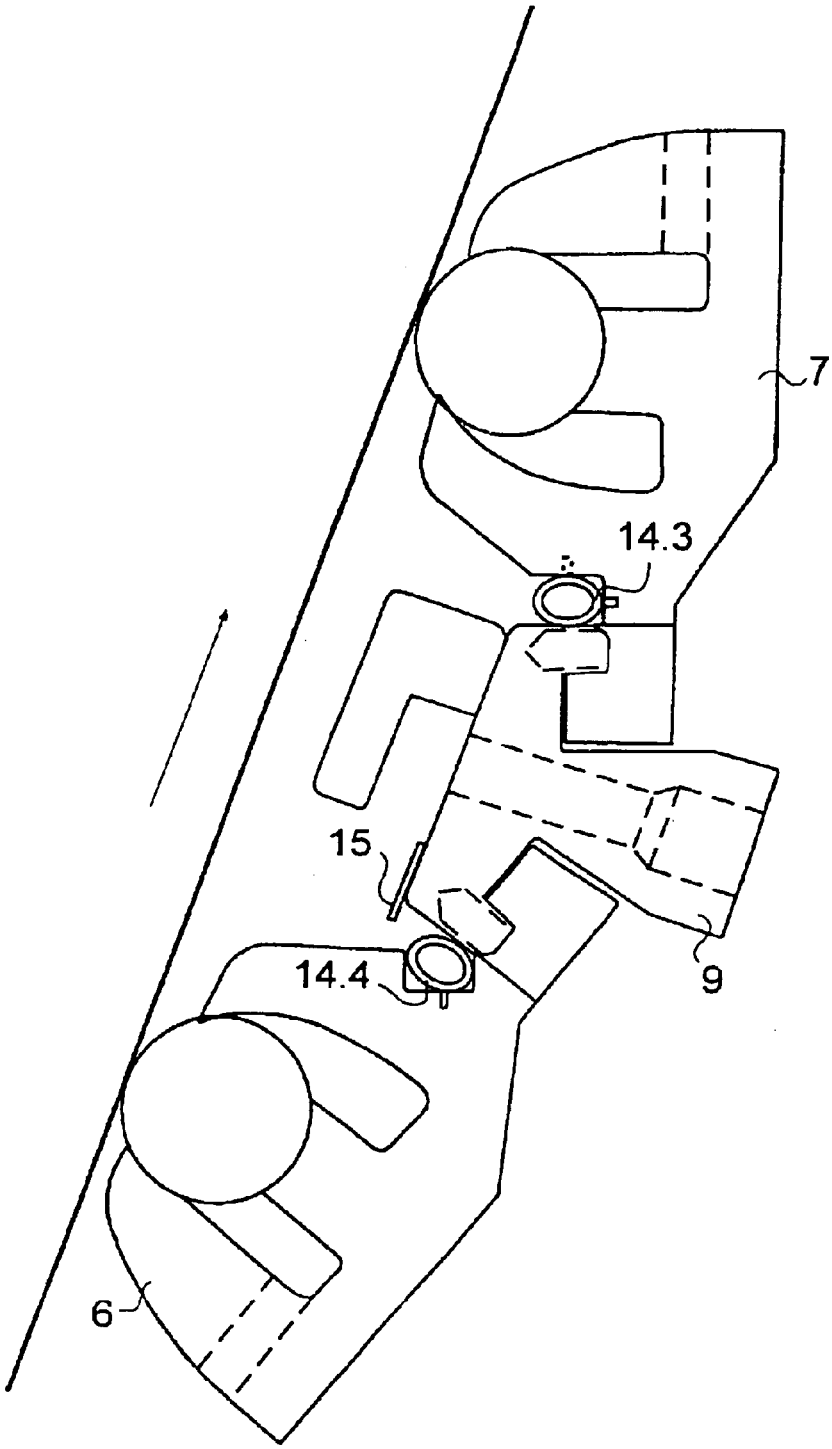
FIGS. 2–5 show rod cradles provided with alternative gaskets.

In FIG. 2, the film rod cradle 7 contains a groove (when required, dovetailed) processed to the cradle above the base, to which a hose gasket 14.3 is fitted. When required, a hose support can be added to the holder. The blocking rod cradle 6 has a corresponding gasket 14.4. In addition, the holder has on its front side a support lath 15, which extends below the lower edge of the front wall. The hoses can suitably be pressurized, when required.

Figure 3:
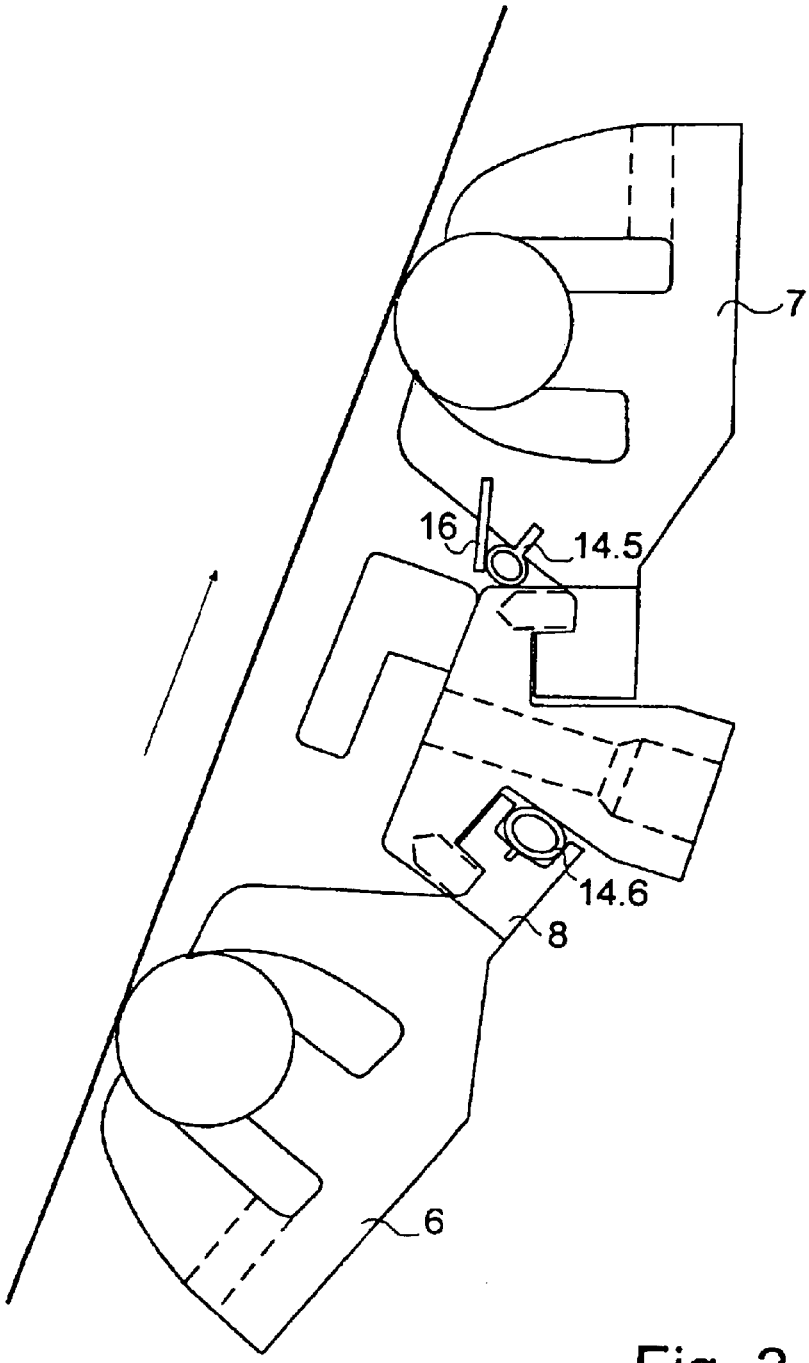

In FIG. 3, a pressurized hose gasket 14.5 is attached to the film rod cradle 7. Its front side is provided with a support lath 16 contacting the hose in the cradle. In the blocking rod cradle 6, a hose gasket 14.6 is attached to a groove formed to the bottom of the base 8.

Figure 4:
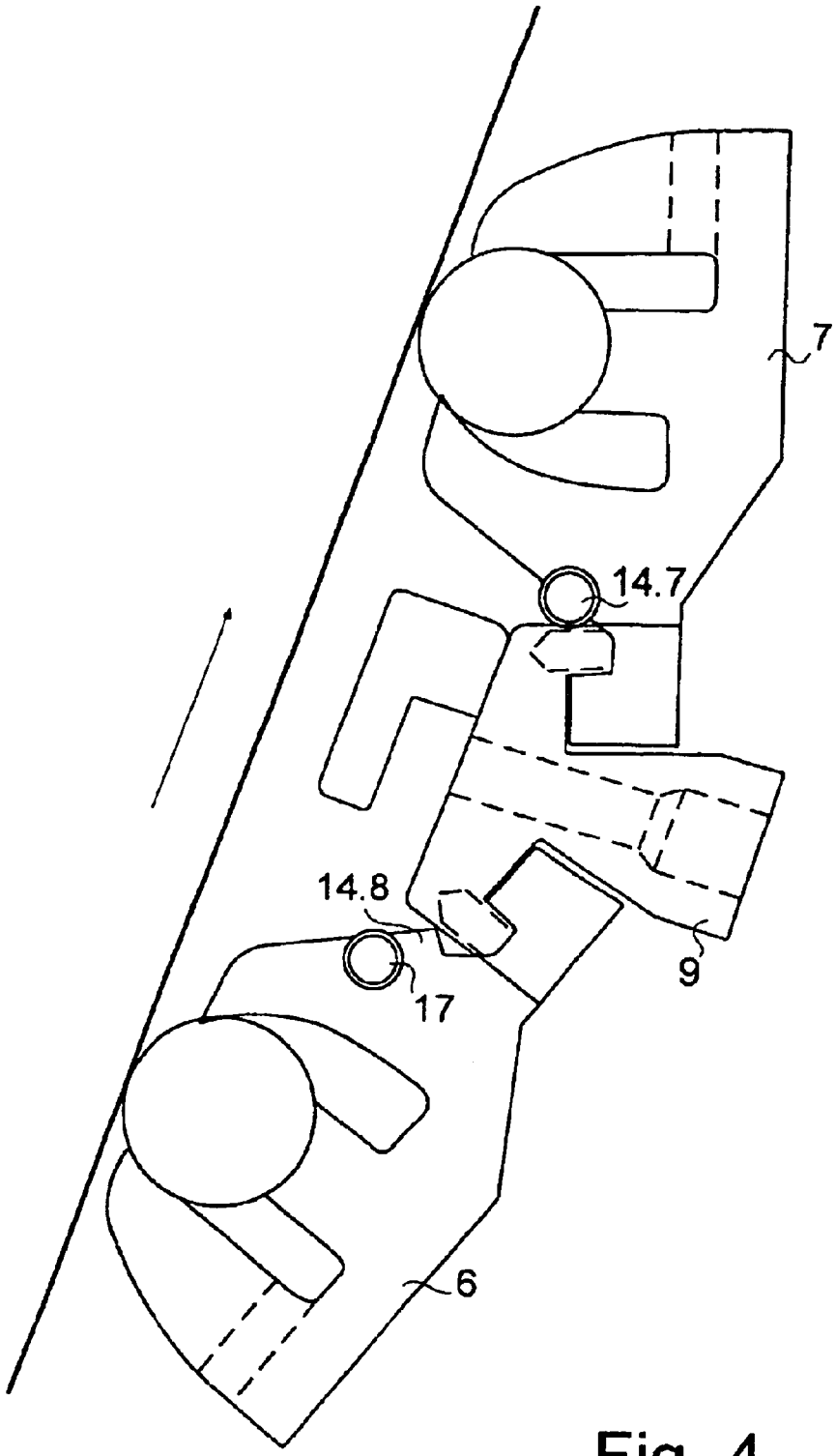

In FIG. 4, a circular (over 180 degrees) groove with a hose gasket 14.7 has been machined to the film rod cradle 7. Such a sealing solution is especially easy to realize. Instead of the hose, also tape can suitably be used here.

In FIG. 4, the blocking rod cradle 6 is provided with a sealing lip 14.8 contacting the holder 9. Above the lip, a pressurized hose 17 is fitted to the circular groove. By increasing the pressure in the hose, the lip can be made to press against the holder with a larger force.

Figure 5:
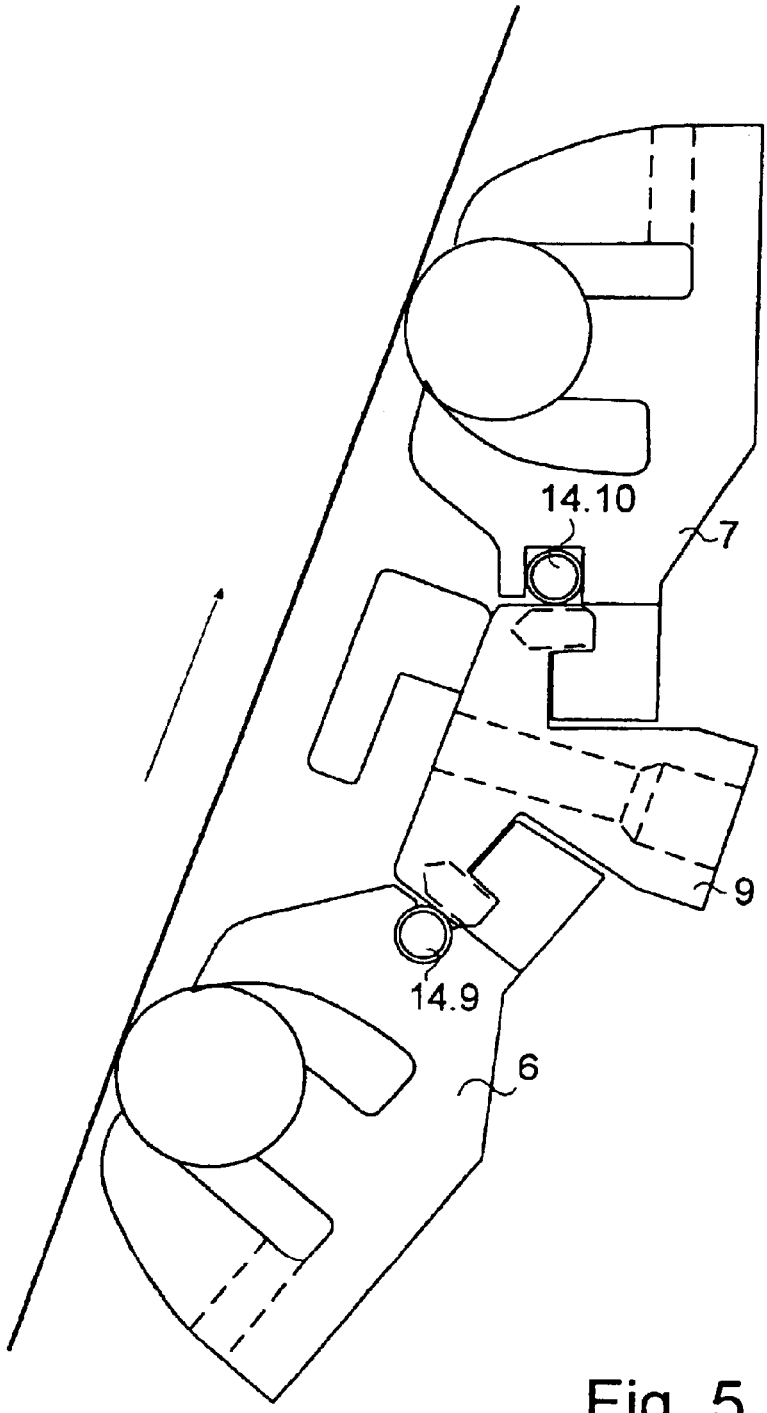

In FIG. 5, the lower part of the cradles 6, 7 has been thickened so that, respectively, more space has been made available for the sealing between the cradle and the holder 9. In this way, the gasket can be pressed substantially perpendicularly against the holder. The blocking rod cradle 6 contains here a circular groove and in it a hose gasket 14.9. In the film rod cradle 7, there is a square groove and in it a hose gasket 14.10.

The fastening of the cradles can be processed also to finished cradles, or the manufacturing molds can be provided with alterations with which the grooves are formed.

Figure 6:
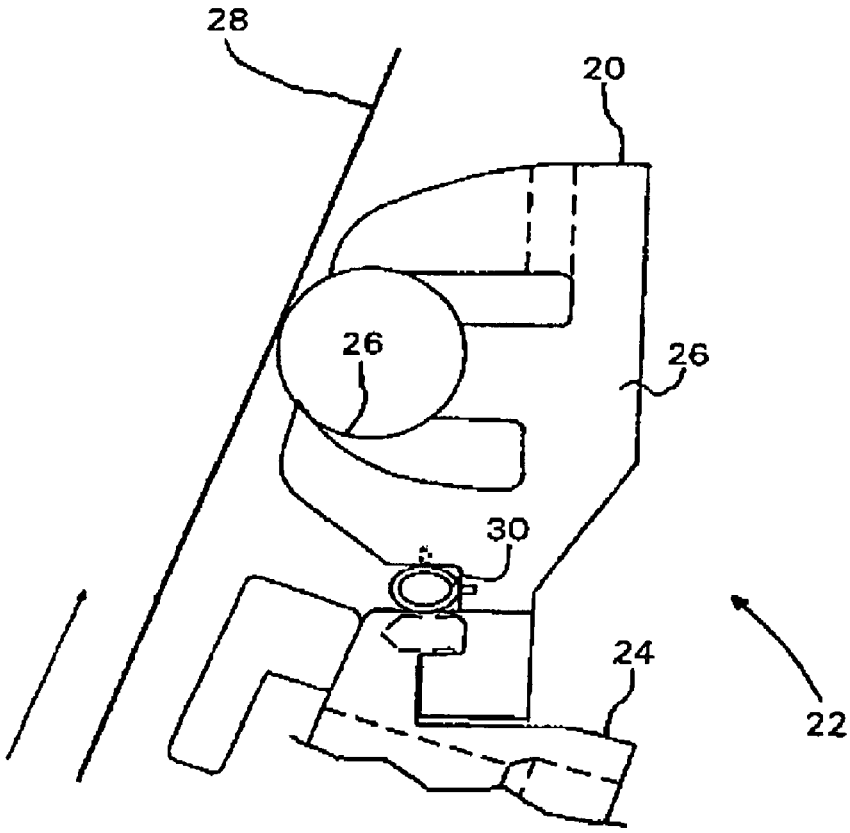
FIG. 6 shows a single cradle for a spreading device fastened to a holder.

It should be is understood that, as shown in FIG. 6, a single cradle 20 for a spreading device 22 may be fastened to a holder 24, the single cradle 20 having a spreading organ formed by a rotatable rod 26 attached to the cradle 20 so the spreading organ 26 is pressed against a movable surface 28. A gasket 30 being provided between the cradle 20 and the holder 24. The gasket 30 may be arranged as shown with respect to the gaskets 14.1–14.10 in FIGS. 1–5.

I claim:

1. A coating apparatus for applying coating against a movable surface, the coating apparatus comprising:

a holder;

a first cradle fastened to the holder, and having a member supported within the first cradle for engagement against the movable surface;

a second cradle fastened to the holder, a fastening between the first cradle and the holder being sufficiently loose so that mobility caused by thermal expansion is possible and a fastening between the second cradle and the holder being sufficiently loose so that mobility caused by thermal expansion is possible;

a spreading organ attached to the second cradle, for pressing within the cradle against the movable surface at a position downstream from the first cradle member, a coating material chamber being defined between the first cradle member, the second cradle organ, the holder, and the movable surface;

wherein the first cradle and the second cradle are movable with respect to the holder toward the movable surface; and a first gasket positioned between the first cradle and the holder to prevent the coating mixture from getting out of the chamber therebetween;

a second gasket positioned between the second cradle and the holder to prevent the coating mixture from getting out of the chamber therebetween.

2. The apparatus of claim 1, wherein the spreading organ is a rotatable rod.

3. The apparatus of claim 1, wherein the second gasket is attached to the second cradle.

4. The apparatus of claim 1, wherein the second gasket is attached to a groove defined within the second cradle.

5. The apparatus of claim 4, wherein portions of the second cradle define & circular groove, and wherein the second gasket is a hose gasket which is attached to the circular groove.

6. The apparatus of claim 1, wherein the second gasket is a hose or tape gasket.

7. A coating apparatus for applying a coating to a moving surface, the apparatus comprising:

a cradle holder;

a film rod cradle mounted to the holder;

a film rod rotatably mounted to the film rod cradle, for pressing against the movable surface;

a blocking rod cradle mounted to the holder upstream of the film rod cradle a blocking rod mounted to the blacking rod cradle for pressing against the movable surface upstream of the film rod, a coating chamber being defined between the blocking rod cradle, the film rod cradle, the holder, and the movable surface; and a first gasket extending between the blocking rod cradle and the holder, wherein portions of the cradle holder define a coating fitting through which a coating material is introduced into the chamber, the gasket forming a seal between the blocking rod cradle and the cradle holder to restrict the escape of the coating material from the coating chamber between the blacking rod cradle and the cradle holder;

a second gasket extending between the film rod cradle and the holder, the gasket forming a seal between the film rod cradle and the cradle holder to restrict the escape of the coating material front the coating chamber between the film rod cradle and the cradle holder.

8. The apparatus of claim 7, wherein the second gasket is attached to a groove defined within the film rod cradle.

9. The apparatus of claim 8, wherein portions of the film rod cradle define a circular groove, and wherein the second gasket is a hose gasket which is attached to the circular groove.

10. The apparatus of claim 7, wherein the second gasket is a hose or tape gasket.

11. A coating apparatus for applying a coating to a moving surface, the apparatus comprising:

a cradle holder;

a first cradle mounted to the holder;

a second cradle mounted to the holder downstream of the first cradle;

a spreading organ mounted to the first cradle, for pressing against the movable surface; and a spreading organ mounted to the second cradle, for pressing against the movable surface; and a first gasket extending between the first cradle and the holder, wherein a coating chamber is defined between to moving surface, the first cradle, the second cradle, and the cradle holder, and wherein portions of the cradle holder define a coating fitting through which a coating material is introduced into the chamber, the first gasket forming a seal between the first cradle and the cradle holder to restrict the escape of the coating material from the coating chamber between the first cradle and the cradle holder, a fastening between the first cradle and the holder being sufficiently loose to permit mobility of the first cradle with respect to the holder caused by thermal expansion;

a second gasket extending between the second cradle and the holder, the second gasket forming a seal between the second cradle and the cradle holder to restrict to escape of the coating material from the coating chamber between the second cradle and the cradle holder, a fastening between the second cradle and the holder being sufficiently loose to permit mobility of the second cradle with respect to the holder caused by thermal expansion.

12. The apparatus of claim 11, wherein the second gasket is attached to a groove defined within the second cradle.

13. The apparatus of claim 11, wherein portions of the second cradle define a circular groove, and wherein the second gasket is a hose gasket which is attached to the circular groove.

14. The apparatus of claim 11 wherein the second gasket is a hose or tape gasket.

15. A coating apparatus for applying a coating to a moving surface, the apparatus comprising:

a cradle holder, a film rod cradle mounted to the cradle holder, a fastening flamed between the cradle and the holder being sufficiently loose to permit mobility of the cradle with respect to the cradle holder caused by thermal expansion;

a film rod rotatably mounted to the film rod cradle, for pressing against a movable surface and a film on the movable surface formed by and extending from the film rod; and an elastomeric gasket extending between the cradle and the holder, wherein portions of the cradle holder define a coating fitting through which a coating material is introduced the gasket tuning a seal between the film rod cradle and the cradle holder to restrict the escape of the coating material from between the film rod cradle and the cradle holder.

16. The apparatus of claim 15, wherein the gasket is attached to a groove defined within the film rod cradle.

17. The apparatus of claim 16, wherein the gasket is a hose gasket mounted in a circular groove extending over 180 degrees within the film rod audio.

18. The apparatus of claim 15, wherein the gasket is a hose gasket which cooperates with a support lath mounted to a front well of the cradle the front wall facing the moving surface.

19. The apparatus of claim 15, wherein the gasket is a hose gasket in a square or round groove in the cradle.

20. The apparatus of claim 15, wherein the gasket is a pressurized hose gasket in a groove which moves a lip forming a part of the audio, against the cradle holder.

21. The apparatus of claim 16, wherein the gasket is lip gasket or a T shaped gasket.

* * * * *

UNITED STATES PATENT AND TRADEMARK OFFICE

CERTIFICATE OF CORRECTION

PATENT NO. : 6,790,280 B2
DATED : September 14, 2004
INVENTOR(S) : Markku Lummila It is certified that error appears in the above-identified patent and that said Letters Patent is hereby corrected as shown below:

Column 4,
Line 52, “&” should be -- a --.

Column 6,
Line 19, “flamed” should be -- formed --.
Line 31, “introduced” should be -- introduced, --.
Line 31, “tuming” should be -- forming --.

Signed and Sealed this

Twenty-ninth Day of March, 2005

JON W. DUDAS
*Director of the United States Patent and Trademark Office*